US008779673B2

(12) United States Patent
Yang

(10) Patent No.: US 8,779,673 B2
(45) Date of Patent: Jul. 15, 2014

(54) LED DEVICE WITH VOLTAGE-LIMITING UNIT AND VOLTAGE-EQUALIZING RESISTANCE

(71) Applicant: Tai-Her Yang, Dzan-Hwa (TW)

(72) Inventor: Tai-Her Yang, Dzan-Hwa (TW)

( * ) Notice: Subject to any disclaimer, the term of this patent is extended or adjusted under 35 U.S.C. 154(b) by 0 days.

(21) Appl. No.: 14/096,267

(22) Filed: Dec. 4, 2013

(65) Prior Publication Data

US 2014/0091721 A1 Apr. 3, 2014

Related U.S. Application Data

(62) Division of application No. 13/025,320, filed on Feb. 11, 2011, now Pat. No. 8,624,508.

(51) Int. Cl.
*H05B 37/02* (2006.01)
*H05B 41/14* (2006.01)

(52) U.S. Cl.
USPC ..... 315/185 R; 315/91

(58) Field of Classification Search
CPC ..... H05B 37/02; H05B 37/00; H05B 33/02; H05B 33/08
USPC ..... 315/185 R, 291, 312, 192, 91, 224
See application file for complete search history.

(56) References Cited

U.S. PATENT DOCUMENTS

| | | | | |
|---|---|---|---|---|
| 6,670,776 | B2 * | 12/2003 | Guthrie et al. | 315/200 A |
| 7,906,915 | B2 * | 3/2011 | Coley | 315/185 S |
| 2011/0127920 | A1 * | 6/2011 | Huang et al. | 315/192 |

* cited by examiner

*Primary Examiner* — Minh D A
(74) *Attorney, Agent, or Firm* — Bacon & Thomas, PLLC

(57) ABSTRACT

The present invention provides a LED device with voltage-limiting unit and voltage-equalizing resistance in which a light-emitting unit is structured through a LED being connected in parallel with a voltage-limiting unit in the same polarity, and two ends thereof being further connected in parallel with an voltage-equalizing resistance, so that when plural sets of the light-emitting units are connected in series or in series-parallel in the same polarity, the end voltage of each set is stabilized by the voltage-equalizing resistance connected in parallel with the two ends of the LED and the voltage-limiting unit.

3 Claims, 2 Drawing Sheets

LED DEVICE WITH VOLTAGE-LIMITING UNIT AND VOLTAGE-EQUALIZING RESISTANCE

This application is a divisional of U.S. patent application Ser. No. 13/025,320, filed Feb. 11, 2011, and now allowed.

BACKGROUND OF THE INVENTION (a) Field of the Invention

According to the present invention, hereinafter the term "LED" is the abbreviation of the light-emitting diode;

The present invention relates to a LED device with voltage-limiting unit and voltage-equalizing resistance in which a light-emitting unit is structured through a LED being connected in parallel with a voltage-limiting unit, and two ends of each LED and voltage-limiting unit being connected in parallel with an voltage-equalizing resistance, so that when plural sets of the light-emitting units are connected in series or in series-parallel in the same polarity, the end voltage of each set is stabilized by the voltage-equalizing resistance connected in parallel with the two ends of the LED and the voltage-limiting unit.

(b) Description of the Prior Art

Conventional LEDs usually parallel connect with the voltage-limiting units at two ends of each LED, such as the zener diode, to constitute the light-emitting unit, thereby when the end voltage of LED is abnormally increased, the abnormal voltage is absorbed by the zener diode; however, when the light-emitting units being parallel connected by the above mentioned LED and the zener diode are series connected (including series-parallel connected) in plural sets, the voltage is not able to be evenly distributed due to the different properties of the LED and the zener diode, so that when subject to abnormal high voltage, the LED loaded with higher end voltage is passed by the higher current therefore the LED is often damaged.

SUMMARY OF THE INVENTION

The present invention provides a LED device with voltage-limiting unit and voltage-equalizing resistance in which a light-emitting unit is structured through a LED being connected in parallel with a voltage-limiting unit in the same polarity, and two ends thereof being further connected in parallel with an voltage-equalizing resistance, so that when plural sets of the light-emitting units are connected in series or in series-parallel in the same polarity, the end voltage of each set is stabilized by the voltage-equalizing resistance connected in parallel with the two ends of the LED and the voltage-limiting unit.

BRIEF DESCRIPTION OF THE DRAWINGS

The present invention will be apparent to those skilled in the art by reading the following detailed description of a preferred embodiment thereof, with reference to the attached drawings, in which.

DESCRIPTION OF MAIN COMPONENT SYMBOLS

101: LED Light-emitting diode
105: Voltage-limiting unit
106: Diode
107: Voltage-equalizing resistance

DETAILED DESCRIPTION OF THE PREFERRED EMBODIMENT

Conventional LEDs usually parallel connect with the voltage-limiting units at two ends of each LED, such as the zener diode, to constitute the light-emitting unit, thereby when the end voltage of LED is abnormally increased, the abnormal voltage is absorbed by the zener diode; however, when the light-emitting units being parallel connected by the above mentioned LED and the zener diode are series connected (including series-parallel connected) in plural sets, the voltage is not able to be evenly distributed due to the different properties of the LED and the zener diode, so that when subject to abnormal high voltage, the LED loaded with higher end voltage is passed by the higher current therefore the LED is often damaged.

The present invention relates to a LED device with voltage-limiting unit and voltage-equalizing resistance in which a light-emitting unit is structured through a LED being connected in parallel with a voltage-limiting unit, and two ends of each LED and voltage-limiting unit being connected in parallel with an voltage-equalizing resistance, so that when plural sets of the light-emitting units are connected in series or in series-parallel in the same polarity, the end voltage of each set is stabilized by the voltage-equalizing resistance connected in parallel with the two ends of the LED and the voltage-limiting unit.

Figure 1:
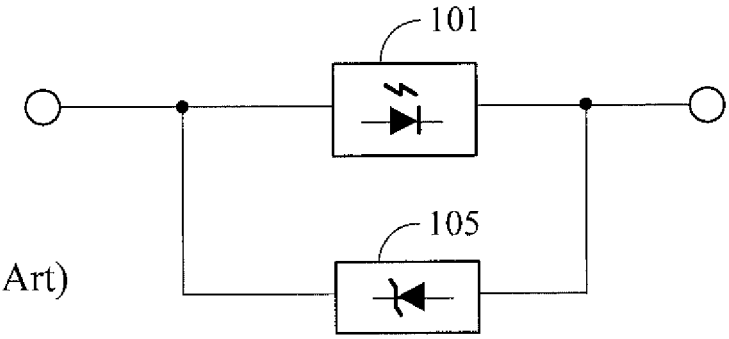
FIG. 1 (Prior Art)
FIG. 1 is a circuit schematic diagram showing that a conventional light-emitting unit is constituted by a LED being connected in parallel with a voltage-limiting unit.

Referring to FIG. 1, which is a circuit schematic diagram showing that a conventional light-emitting unit is constituted by a LED being connected in parallel with a voltage-limiting unit.

As shown in FIG. 1, a light-emitting unit is structured through a LED being parallel-connected in the same polarity with a zener diode.

Figure 2:
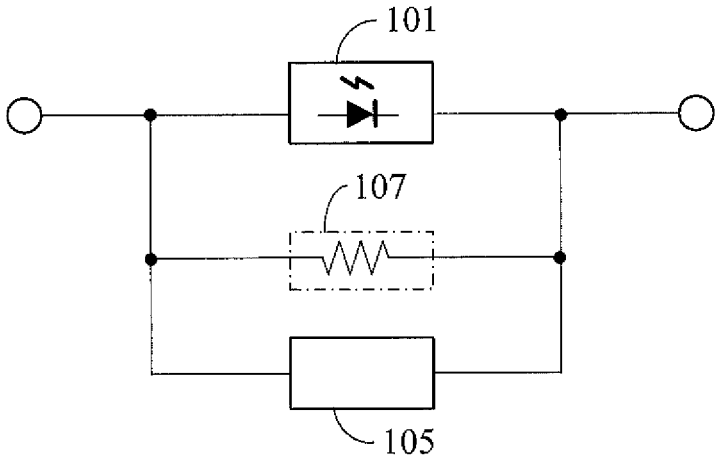
FIG. 2 is a circuit schematic diagram showing that a light-emitting unit is constituted by a LED being connected in parallel with a voltage-limiting unit then connected in parallel with a voltage-equalizing resistance, according to the present invention.

Referring to FIG. 2, which is a circuit schematic diagram showing that a light-emitting unit is constituted by a LED being connected in parallel with a voltage-limiting unit then connected in parallel with a voltage-equalizing resistance, according to the present invention.

As shown in FIG. 2, it mainly consists of:

LED (101): constituted by the light emitting diode;

Voltage-limiting unit (105): constituted by a semiconductor unit, e.g. a zener diode or a varistor, with a property of the resistance thereof being rapidly dropped when subject to overvoltage;

Voltage-equalizing resistance (107): constituted by the resistive component and served to be parallel connected at two ends of each LED;

Wherein a light-emitting unit is structured through connecting the LED (101) in parallel with the voltage-limiting unit (105) then further connecting in parallel with the voltage-equalizing resistance (107).

Figure 3:
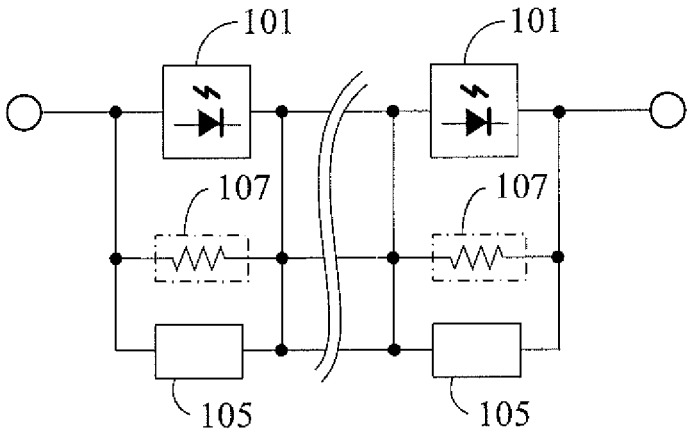
FIG. 3 is a circuit schematic diagram showing that two or more than two of the light-emitting units as shown in FIG. 2 are connected in series or in series-parallel in the same polarity to constitute the light-emitting unit set.

Referring to FIG. 3, which is a circuit schematic diagram showing that two or more than two of the light-emitting units as shown in FIG. 2 are connected in series or in series-parallel in the same polarity to constitute the light-emitting unit set;

As shown in FIG. 3, it mainly consists of:

LED (101): constituted by the light emitting diode;

Voltage-limiting unit (105): constituted by a semiconductor unit, e.g. a zener diode or a varistor, with a property of the resistance thereof being rapidly dropped when subject to overvoltage;

Voltage-equalizing resistance (107): constituted by the resistive component and served to be parallel connected at two ends of each LED;

wherein a light-emitting unit is structured through connecting the LED (101) in parallel with the voltage-limiting unit (105) then further connecting in parallel with the voltage-equalizing resistance (107);

And a light-emitting unit set is structured through series-connecting or series-parallel connecting two or more than two of the mentioned light-emitting units in the same polarity.

Figure 4:
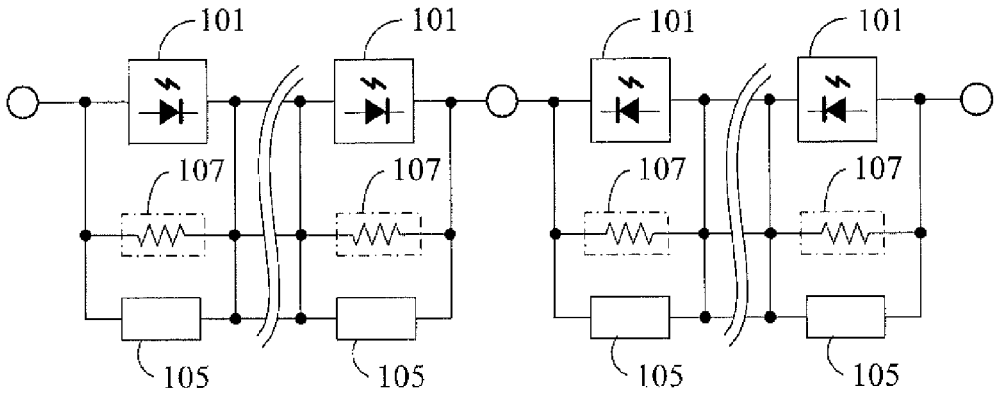
FIG. 4 is an applied circuit schematic diagram wherein two or more than two of the light-emitting unit sets as shown in FIG. 3 are in reverse-polarity series connection.

Referring to FIG. 4, which is an applied circuit schematic diagram wherein two or more than two of the light-emitting unit sets as shown in FIG. 3 are in reverse-polarity series connection;

As shown in FIG. 4, it mainly consists of:

LED (101): constituted by the light emitting diode;

Voltage-limiting unit (105): constituted by a semiconductor unit, e.g. a zener diode or a varistor, with a property of the resistance thereof being rapidly dropped when subject to overvoltage;

Voltage-equalizing resistance (107): constituted by the resistive component and served to be parallel connected at two ends of each LED;

wherein a light-emitting unit is structured through connecting the LED (101) in parallel with the voltage-limiting unit (105) then further connecting in parallel with the voltage-equalizing resistance (107);

And a light-emitting unit set is structured through series-connecting or series-parallel connecting two or more than two of the mentioned light-emitting units in the same polarity;

Two or more than two of the mentioned light-emitting unit sets are connected in series in the reverse polarity.

Figure 5:
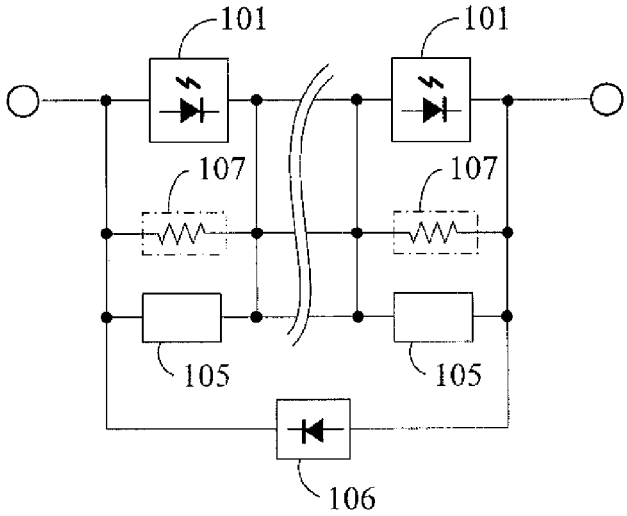
FIG. 5 is an applied circuit schematic diagram showing that two ends of the light-emitting unit set, shown in FIG. 3 and constituted by two or more than two light-emitting units in series or series-parallel connection in the same polarity, are in reverse-polarity parallel connection with a diode.

Referring to FIG. 5, which is an applied circuit schematic diagram showing that two ends of the light-emitting unit set, shown in FIG. 3 and constituted by two or more than two light-emitting units in series or series-parallel connection in the same polarity, are in reverse-polarity parallel connection with a diode;

As shown in FIG. 5, it mainly consists of:

LED (101): constituted by the light emitting diode;

Voltage-limiting unit (105): constituted by a semiconductor unit, e.g. a zener diode or a varistor, with a property of the resistance thereof being rapidly dropped when subject to overvoltage;

Voltage-equalizing resistance (107): constituted by the resistive component and served to be parallel connected at two ends of each LED;

wherein a light-emitting unit is structured through connecting the LED (101) in parallel with the voltage-limiting unit (105) then further connecting in parallel with the voltage-equalizing resistance (107);

And a light-emitting unit set is structured through series-connecting or series-parallel connecting two or more than two of the mentioned light-emitting units in the same polarity;

Two ends of the mentioned series-connected light-emitting unit set in the same polarity are connected in parallel in the reverse polarity with a diode (106).

Figure 6:
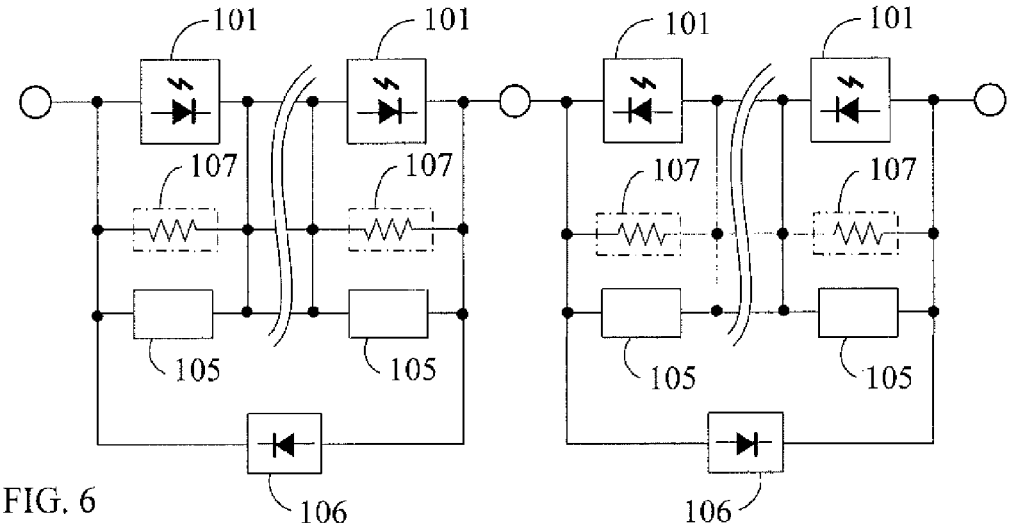
FIG. 6 is an applied circuit schematic diagram showing that the light-emitting unit sets, constituted by two or more than two of the light-emitting unit sets as shown in FIG. 4, are in reverse-polarity series connection, and two ends of the reverse-polarity series light-emitting unit sets of different polarity sides are connected in series in the same polarity then are respectively connected in parallel in the same polarity with a diode.

Referring to FIG. 6, which is an applied circuit schematic diagram showing that the light-emitting unit sets, constituted by two or more than two of the light-emitting unit sets as shown in FIG. 4, are in reverse-polarity series connection, and two ends of the reverse-polarity series light-emitting unit sets of different polarity sides are connected in series in the same polarity then are respectively connected in parallel in the same polarity with a diode;

As shown in FIG. 6, it mainly consists of:

LED (101): constituted by the light emitting diode;

Voltage-limiting unit (105): constituted by a semiconductor unit, e.g. a zener diode or a varistor, with a property of the resistance thereof being rapidly dropped when subject to overvoltage;

Voltage-equalizing resistance (107): constituted by the resistive component and served to be parallel connected at two ends of each LED;

wherein a light-emitting unit is structured through connecting the LED (101) in parallel with the voltage-limiting unit (105) then further connecting in parallel with the voltage-equalizing resistance (107);

And a light-emitting unit set is structured through series-connecting or series-parallel connecting two or more than two of the mentioned light-emitting units in the same polarity;

Two or more than two of the mentioned light-emitting unit sets are connected in series in the reverse polarity;

In the light-emitting unit sets of different polarity sides, which are connected in series in the reverse polarity, two ends of the plural light-emitting unit sets in normal-polarity series connection or series-parallel connection are respectively connected in parallel in the reverse polarity with a diode (106).

According to the LED device with voltage-limiting unit and voltage-equalizing resistance of the present invention, the mentioned LED (101) can not only be structured with a single LED (101), but two or more than two LEDs (101) can be provided for structuring a LED unit through connecting the LEDs in series, in parallel or in series and parallel to replace the single LED (101).

According to the LED device with voltage-limiting unit and voltage-equalizing resistance of the present invention, the voltage-limiting protective unit consists one or more than more of the following units, wherein one or more than one units being in same-polarity series, parallel or series and parallel connection, which include:

zener diode;

varistor;

diode with property of forward voltage drop;

zener diode with property of reverse-polarity forward voltage drop

According to the present invention, the power source for the provided LED device can be a constant-current power source or constant-voltage power source, or a current-limiting power source or voltage-limiting power source, or a power source wherein voltage and current not being particularly controlled; for cooperating the operation of the voltage-limiting unit of the present invention, an internal impedance at an output end of the power source or an impedance unit between the output end of the power source and the loading can be further provided, so when the voltage of the power source is altered, the current passing through the voltage-limiting unit generates a voltage drop at the two ends of the impedance unit, and a voltage regulation effect is provided to the voltage at the two ends of the LED device of the present invention.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific examples of the embodiments disclosed and that modifications and other embodiments are intended to be included within the scope of the appended claims. Although specific terms are employed herein, they are used in a generic and descriptive sense only and not for purposes of limitation.

The invention claimed is:

1. An LED device, comprising:

at least two light-emitting units, each said light-emitting unit including:

at least one light-emitting diode (101);

a voltage-limiting unit (105) connected in parallel with the at least one light-emitting diode (101), the voltage-limiting unit (105) including a semiconductor unit having a resistance that rapidly drops when subject to overvoltage;

a voltage-limiting resistance (107) connected in parallel with the at least one light-emitting diode (101), the voltage-limiting resistance (107) including a resistive component;

wherein said at least two of the light-emitting units are connected in series or series-parallel with a respective said at least one light-emitting diode (101) in each of said at least two light-emitting units having a same polarity.

2. The LED device with voltage-limiting unit and voltage-equalizing resistance as claimed in claim 1, wherein at least one said LED unit includes at least two LEDs (101) connected in series, in parallel, or in series and parallel.

3. An LED device as claimed in claim 1, wherein said at least two light-emitting units form a first light-emitting unit set and said first light-emitting unit set is connected to a second said light-emitting unit set, and wherein a polarity of the light-emitting diodes in the first light-emitting unit set is opposite a polarity of the light-emitting diodes in the second light-emitting unit set.

* * * * *